US008839737B2

(12) United States Patent
Weber

(10) Patent No.: US 8,839,737 B2
(45) Date of Patent: Sep. 23, 2014

(54) METHOD AND DEVICE FOR CHANGING THE CONDITION OF A WEB OF FOIL

(75) Inventor: Alexander Weber, Weinheim (DE)

(73) Assignee: Heidleberger Druckmaschinen AG, Heidelberg (DE)

( * ) Notice: Subject to any disclaimer, the term of this patent is extended or adjusted under 35 U.S.C. 154(b) by 192 days.

(21) Appl. No.: 13/328,054

(22) Filed: Dec. 16, 2011

(65) Prior Publication Data

US 2012/0152444 A1 Jun. 21, 2012

(30) Foreign Application Priority Data

Dec. 16, 2010 (DE) ..... 10 2010 054 706

(51) Int. Cl.

| | |
|---|---|
| ***B05C 1/12*** | (2006.01) |
| ***B05C 1/08*** | (2006.01) |
| ***B05C 1/04*** | (2006.01) |
| ***B05C 1/00*** | (2006.01) |
| ***B44C 1/17*** | (2006.01) |
| ***B44C 3/08*** | (2006.01) |
| ***B65C 9/46*** | (2006.01) |
| ***B44C 1/165*** | (2006.01) |
| ***B44C 1/16*** | (2006.01) |
| ***B41F 23/04*** | (2006.01) |
| ***B41F 19/00*** | (2006.01) |

(52) U.S. Cl.

CPC ..... *B41F 19/001* (2013.01); *B41F 23/0453* (2013.01); *B41P 2219/22* (2013.01)

USPC ..... 118/223; 118/216; 118/209; 118/200; 156/219; 156/234; 156/387

(58) Field of Classification Search

None

See application file for complete search history.

(56) References Cited

U.S. PATENT DOCUMENTS

| | | | | |
|---|---|---|---|---|
| 4,789,420 | A * | 12/1988 | LaManna et al. | 156/540 |
| 5,639,340 | A * | 6/1997 | Volk | 156/579 |
| 5,927,204 | A * | 7/1999 | Waaijer | 101/420 |
| 6,109,326 | A * | 8/2000 | Leakey et al. | 156/553 |
| 7,793,697 | B2 | 9/2010 | Weber et al. | |
| 2006/0254445 | A1 | 11/2006 | Masuda | |
| 2009/0078364 | A1 | 3/2009 | Yamashita et al. | |
| 2009/0294039 | A1 | 12/2009 | Weber | |

FOREIGN PATENT DOCUMENTS

| | | | |
|---|---|---|---|
| DE | 10 2006 021 069 | A1 | 11/2006 |
| DE | 10 2008 042 194 | A1 | 4/2009 |
| DE | 10 2007 061 400 | A1 | 6/2009 |

(Continued)

*Primary Examiner* — Dah-Wei D Yuan

*Assistant Examiner* — Jethro Pence

(74) *Attorney, Agent, or Firm* — Laurence A. Greenberg; Werner H. Stemer; Ralph E. Locher

(57) ABSTRACT

A device and a method for coating a printing material include a foil engaged with a printing material on an impression cylinder using guide rollers. The foil and the printing material are guided together in an engagement area and a functional layer, such as glue or varnish, is dried, i.e. activated or polymerized, through the foil in the engagement area using a drier. The guide rollers are disengaged from the impression cylinder to avoid contact between the foil and grippers of the impression cylinder. To improve a detachment behavior of the foil from the functional layer, an angle of detachment between the foil and the sheet is varied by pivoting the guide rollers about an external geometrical pivot axis or an internal geometrical pivot axis, or at least assisting the disengagement of the foil from the impression cylinder by a change of a pneumatic condition of a foil-guiding element.

11 Claims, 4 Drawing Sheets

(56) References Cited

FOREIGN PATENT DOCUMENTS

| | | | | | |
|---|---|---|---|---|---|
| DE | 10 2009 002 810 | A1 | | 11/2009 | |
| DE | 10 2009 020 103 | A1 | | 12/2009 | |
| WO | 2009/138335 | A1 | | 11/2009 | |
| WO | WO2009138335 | A1 | * | 11/2009 | ..... B41F 19/06 |

* cited by examiner

METHOD AND DEVICE FOR CHANGING THE CONDITION OF A WEB OF FOIL

CROSS-REFERENCE TO RELATED APPLICATION

This application claims the priority, under 35 U.S.C. §119, of German Patent Application DE 10 2010 054 706.9, filed Dec. 16, 2010; the prior application is herewith incorporated by reference in its entirety.

BACKGROUND OF THE INVENTION

Field of the Invention

The present invention relates to a method and a device for coating printing material using a web of foil that contacts the printing material at least temporarily and is brought together with the printing material after the latter has been coated with a functional coating such as glue or a varnish.

Many methods and devices for enhancing printed products have become known in the prior art. The enhancement process may be carried out within a printing press (i.e. in-line) or outside the printing press (i.e. off-line). The enhancement measures may be taken before or after the printing operation.

Two known finishing operations are cold-foil coating of a printing material and the creation of structures such as holograms or diffractive structures on the surface of the printing material.

Cold-foil coating can be performed within a sheet-fed machine, in particular in an in-line process in a sheet-fed printing press. For that purpose, a printing material that is yet unprinted or one that has already been printed receives a layer of glue, in particular in areas depending on an image to be applied, in a first printing unit. The sheet that has received the glue may then be fed to a transfer unit in which it is passed through a transfer nip together with a web of foil. In cold-foil stamping, the web of foil is generally formed of a carrier layer and a transfer layer, which is detached from the transfer foil and transferred to the printing material in the transfer nip. The printing material is guided through the transfer nip on an impression cylinder for that purpose. If the printing material is a sheet, it is held on the impression cylinder. The transfer nip is formed by a transfer cylinder and the impression cylinder. Foil-guiding elements guide the transfer foil, which is formed of the transfer layer and the carrier layer, through the transfer nip together with the sheet. At least in the transfer nip, the web of foil is guided together with the sheet on the impression cylinder, in that case in functional terms by the transfer cylinder. The transfer layer is detached from the carrier and is transferred to the printing material under pressure in the areas that are coated with glue on the printing material. The printing material that has been coated in that way can then undergo further printing operations in downstream printing units of the printing press.

In another known enhancement process using a foil, a structure, in particular a hologram or a diffractive structure, is applied to the surface of the printing material. For that purpose, a functional coating, in particular a layer of varnish, is applied to the printing material in a first printing unit or varnishing unit. The printing material that has received the varnish is then fed to a finishing unit provided in the printing press. If the printing material is a sheet, it is guided on the impression cylinder of the finishing unit and potentially held by grippers. In that process too, a foil, in that case in particular a hologram foil, is guided along the impression cylinder at least temporarily together with the printing material. The web of foil has a side that faces the printing material and has a fine structure that becomes submerged into the layer of varnish that has not yet polymerized on the printing material and may thus create an embossing in the layer of varnish on the printing material without affecting the printing material itself. Thus, a microstructure may be embossed into the varnish to provide a glossy, holographic or hologram-like visual effect to the human eye. That process of embossing a non-polymerized layer of varnish as far as possible without embossing the printing material that lies underneath, is also known as UV casting. In general, the varnish is hardened while it is still in contact with the foil. The hardening is achieved by using UV varnish and a UV drier above the web of foil. For that purpose, the web of foil needs to be transparent and must be guided on the impression cylinder together with the printing material over a longer distance to be able to dry the varnish using a UV drier while the foil is being pressed onto the varnish. A suitable device for that process is disclosed in German Published Patent Application DE 10 2006 021 069 A1, corresponding to U.S. Patent Application Publication No. US 2006/0254445.

In the case of cold-foil transfer, there are likewise a device and a method in which the foil wraps around the impression cylinder over a longer distance and at a wrap angle $\alpha$ relative to the impression cylinder, to be guided together with the sheet on the impression cylinder during an extended period of time. German Published Patent Application DE 10 2009 002 810 A1, corresponding to International Publication No. WO 2009/138335 A1, discloses the use of a cylinder that forms a pressure nip as a foil-guiding element and provides another guide element, which is substantially engaged with the impression cylinder, at a distance from the first cylinder to guide the foil over the impression cylinder. A drier for drying the glue is provided in the region between the two guide cylinders.

In both devices that guide the foil along the impression cylinder to create an embossing in the layer of varnish on one hand or to deposit the transfer foil on the printing material on the other hand, a provision may be made for at least one of the two guide rollers to be disengaged from the surface of the impression cylinder in a substantially vertical direction. That may be useful, for instance, to avoid a collision with grippers for guiding the sheet on the impression cylinder.

It is possible to avoid the grippers by using the known devices. However, those devices require complex configurations that may influence the tension of the foil. Moreover, the devices described above are static in terms of the detachment behavior of the foil from the printing material or sheet. They do not take into consideration that different foils, different printing materials, or different types of varnish or glue may require different detachment behavior.

SUMMARY OF THE INVENTION

It is accordingly an object of the invention to provide a method and a device for changing the condition of a web of foil, which overcome the hereinafore-mentioned disadvantages and at least counteract the difficulties of the heretofore-known methods and devices of this general type.

With the foregoing and other objects in view there is provided, in accordance with the invention, a method for coating a printing material using a web of foil. The method comprises applying a coating of glue, varnish or another functional layer to the printing material, feeding a web of foil from a foil supply to an area of engagement using foil-guiding elements, engaging the web of foil temporarily with the printing material in the area of engagement while guiding the printing material on a counter-surface, preferably of an impression cylinder, changing a path of the web of foil relative to the counter-surface at least from a first condition to a second condition using the foil-guiding elements to guide the web of foil, and implementing the change of condition by changing at least one condition of at least one of the foil-guiding elements to switch the web of foil from a first to a second condition, the change of condition of the at least one foil-guiding element being different from a disengagement of the at least one foil-guiding element from the counter-surface.

With the objects of the invention in view, there is also provided a device for coating a printing material. The device comprises at least one coating unit for coating the printing material with a functional substrate, an area of engagement, disposed downstream of the at least one coating unit in a transport direction of the printing material, for temporarily engaging a web of foil with the printing material, a counter-surface, preferably of an impression cylinder, for guiding the printing material during engagement with the web of foil, a guide device including foil-guiding elements for guiding the web of foil in vicinity of the counter-surface, and a switching element associated with at least one of the foil-guiding elements and configured to be switched for causing a change of condition of the at least one foil-guiding element, the change of condition being different than a disengagement of the at least one foil-guiding element from the counter-surface, and the switching of the switching element causing the web of foil to change from a first condition to a second condition.

Therefore, in accordance with the invention, the method includes the steps of applying glue or a layer of varnish to a printing material and guiding the printing material and a web of foil in an area of engagement on a counter-surface, which is preferably an impression cylinder. Alternatively, the printing material may be coated using other functional material to create a functional layer. The other functional material may, for instance, be a layer of ink or a layer of a conductive material or a primer or the like.

The aforementioned counter-surface is preferably formed by an impression cylinder, and the foil and the printing material are jointly fed to a first nip. The first nip is formed by a first guide roller and the impression cylinder. The first guide roller may, in particular, be a blanket cylinder of a printing unit or an imaging cylinder of a coating unit of a printing press. In order to provide a larger area of engagement, a second foil-guiding element in the form of a deflection roller is provided. This deflection roller is engaged with the impression cylinder at a location downstream of the first nip. The sheet itself is guided by a gripper on the impression cylinder. Due to the two guide rollers provided in the circumferential region of the impression cylinder the foil is guided around the impression cylinder together with the sheet at a defined angle of engagement.

In order to harden the glue or to polymerize a varnish, a UV drier may be provided, in particular between the two guide rollers.

In order to feed the web of foil to the area of engagement, foil-guiding elements are provided to guide the web of foil itself to the area of engagement from a foil supply, for instance a foil-supply reel.

In addition, a provision is made to change the path of the web of foil relative to the respective counter-surface or impression cylinder, from a first condition to a second condition, preferably in the vicinity of the area of engagement. This may be necessary, for example, to disengage the web of foil from the impression cylinder when the grippers pass underneath the area of engagement. Preferably, a change of condition alternatively or additionally results in a different angle of detachment of the web of foil from the printing material, so as to be able to control the detachment behavior of the varnish from a foil, in particular a hologram foil, or of a carrier foil from a transfer layer on the printing material.

This change of condition of the web of foil may, in particular, be caused by at least one of the foil-guiding elements for guiding the web of foil. For this purpose, a change of condition of the foil-guiding element(s), which is different than a disengagement of the foil-guiding element from the counter-surface, is envisaged. As a result of such different changes of condition, it is in particular possible to implement different foil paths to influence the detachment behavior of the foil from the underlying functional layer.

In accordance with the invention, the device includes guide devices having foil-guiding elements for guiding the web of foil at least in the region of the counter-surface. In addition, a suitable coating unit for coating the printing material with a functional substance such as varnish or glue is provided upstream of the area of engagement as viewed in the direction of transport of the printing material. This coating unit may be a self-contained inking or varnishing unit of a printing press. Moreover, at least one foil-guiding element is assigned a switching member for causing corresponding changes of condition of the foil-guiding element which are different from a disengagement of the foil-guiding element from the counter-surface. In order to achieve a corresponding change of condition of the foil-guiding element for the purpose of changing the web of foil from a first condition to a second condition, the switching member is switchable in a manner corresponding to the change of condition of the foil-guiding element.

The changes of condition of the foil-guiding elements, which are different from a disengagement of the foil-guiding element from the counter-surface, may be one change of condition out of a group including pivoting about an interior or exterior geometrical pivot axis and a change of a pneumatic condition.

Thus, in accordance with one embodiment of the device of the invention, a change of the pneumatic condition may be caused by a pneumatically activatable guide element. In accordance with a further development of the device of the invention, this guide element may include suction-air openings and/or compressed-air openings to receive or expel air. If the web of foil is to be disengaged from the respective counter-surface or impression cylinder, the detachment of the web of foil from the counter-surface may at least be assisted by providing suction air to the suction openings of the pneumatically activatable guide element. An engagement of the web of foil with the impression cylinder, in particular to generate a predefined force, may additionally or alternatively be assisted by the provision of compressed air that is pressed through the compressed-air openings of the pneumatically activatable guide element.

In accordance with an additional or alternative embodiment of the invention, the change of condition of the foil may reside in a change of the angle of detachment of the foil relative to the counter-surface, i.e. the impression cylinder, or relative to the printing material itself. In accordance with the method of the invention, this change of condition may be achieved by changing the surface area of the foil-guiding element that is in interaction with the counter-surface in the region of the detachment of the web of foil from the counter-surface. This may be attained on one hand by pivoting the foil-guiding element, which is preferably a guide roller, about an external geometrical pivot axis to substantially exclusively achieve a circumferential adjustment of the foil-guiding element, i.e. the guide roller. This pivoting movement to a different circumferential position causes the foil-guiding area about the impression cylinder to change and an angle of detachment of the foil to vary at least if there is a stationary second guide roller or guide element outside the area of engagement. For this purpose, the geometrical pivot axis is preferably located inside the impression cylinder.

In accordance with an alternative embodiment of the device of the invention, the foil-guiding element has an internal geometrical pivot axis about which the guide element is pivotable. In this case, the guide-element itself has a surface profile that provides different effective surfaces for guidingly interacting with the foil as a function of the pivoting condition. The path of the foil in the region of the location of detachment of the foil from the printing material differs in accordance with the different surface areas that interact with the foil. Thus, a different angle of detachment of the foil can be achieved as a function of the pivoting condition.

In order to reduce friction between the foil and the foil-guiding elements, holes can be provided in the adjustable and in the profiled foil-guiding elements. Air may exit through these holes to form an air cushion between the web of foil and the foil-guiding element. These holes may, in particular, have a microstructure to provide an air cushion that is as uniform as possible.

A suitable device for pivoting the foil-guiding element about an external geometrical pivot axis is provided to ensure radial pivotability of the foil-guiding element. In this context, a provision is made for the radial distance between the guide element and the counter-surface to remain substantially unchanged.

Other features which are considered as characteristic for the invention are set forth in the appended claims.

Although the invention is illustrated and described herein as embodied in a method and a device for changing the condition of a web of foil, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
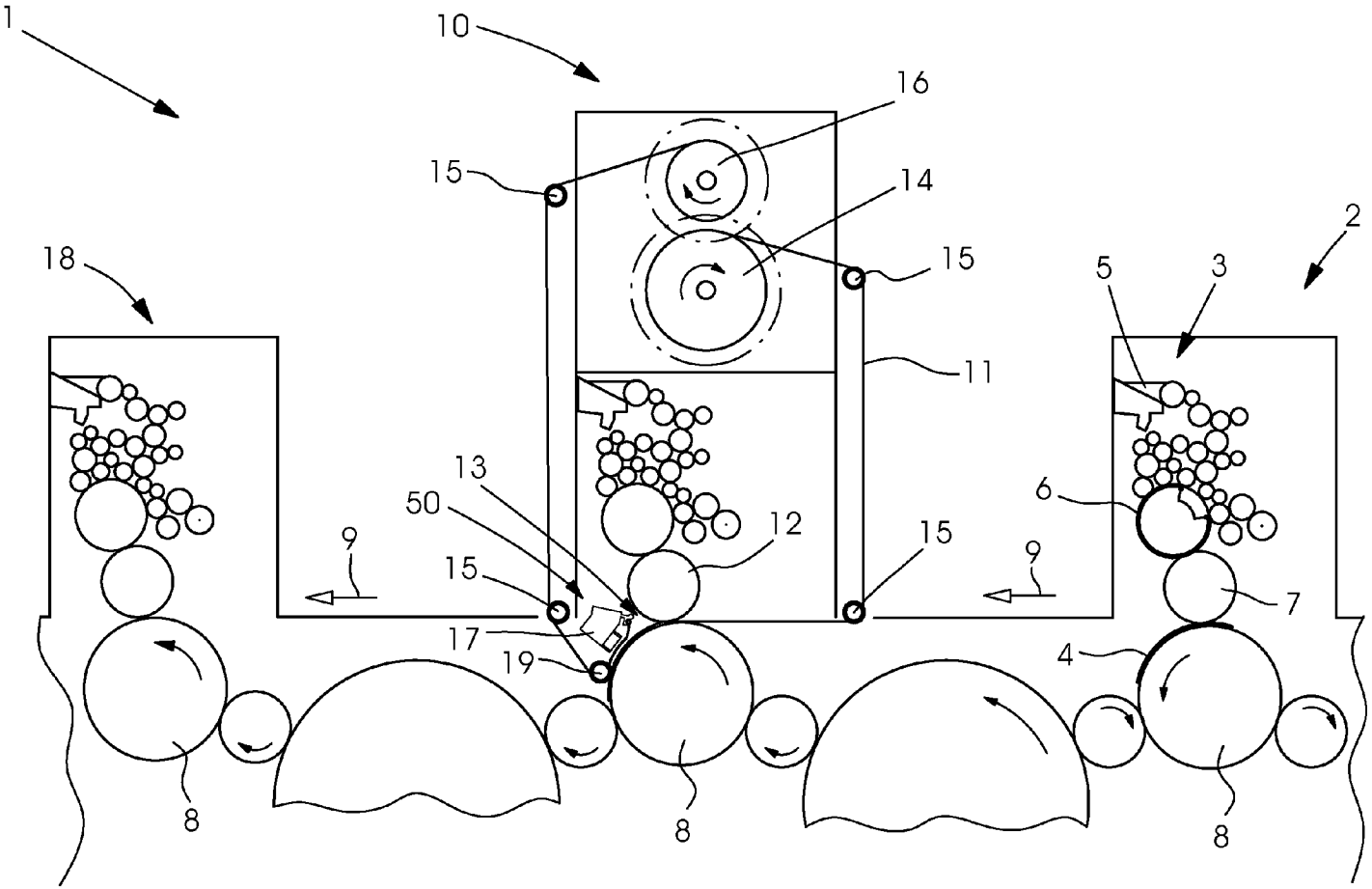
FIG. 1 (Prior Art)
FIG. 1 is a fragmentary, diagrammatic, longitudinal-sectional view of a cold-foil device in accordance with the prior art.

Referring now in detail to the figures of the drawings, which disclose exemplary embodiments of the method and device that do not limit the invention in any way and may provide additional features, and first, particularly, to FIG. 1 thereof, there is seen a printing press 1 including a transfer unit 10 known from the prior art. The illustration only represents a section of the printing press 1 including an application unit 2, the transfer unit 10 and a downstream printing unit 18.

A sheet 4 is guided into the application unit 2 from a (non-illustrated) feeder and potentially further printing units 18. The application unit 2 includes a supply of glue 5, from which glue is supplied to an inking unit 3 to be applied to a plate cylinder 6 carrying a printing plate. The glue is applied to a blanket cylinder 7 by the plate cylinder in accordance with the image on the printing plate and is then applied to the sheet 4 in an indirect printing process. The sheet 4 is held on an impression cylinder 8 by grippers. In an alternative embodiment, a varnishing unit may be used to transfer the glue. The glue may be applied either in areas as defined by the image, for instance using a varnishing blanket that has cutouts, or across the entire area in a varnishing unit.

Having passed the application unit 2 and received a glue image, the sheet 4 continues to be guided through the printing press 1 in a direction of transport 9. The sheet 4 passes a transfer nip 13 in the transfer unit 10. The sheet 4 is guided through the transfer nip 13 together with a cold foil 11. In the process, a transfer layer of the transfer foil 11 is transferred, potentially under the influence of force, to the areas of the sheet 4 that have received the glue.

For this purpose, guide elements 15, in this embodiment constructed as rollers, guide the cold foil 11 from a supply reel 14 into the transfer nip 13, which is formed by an impression cylinder 8 and a transfer cylinder 12 that is a blanket cylinder of a printing unit of the printing press 1. Once the cold foil 11 and the sheet 4 have passed the transfer nip 13 together, a foil-guiding element 15 and a second foil-guiding element 19 guide the transfer foil 11, which still carries areas of the transfer layer that have not been transferred, to a collecting reel 16. The sheet 4, which has now received the transfer layer, continues to be moved through the printing press to the downstream printing unit 18 in the direction of transport 9. It may pass through further printing units or devices for the further processing of printed products in the printing press 1.

In order to obtain a firm bonding between the transfer layer of the transfer foil 11 and the sheet 4, an area of engagement 50 is provided on the impression cylinder 8. This area of engagement 50 directly follows the transfer nip 13 and extends across an area on the surface of the impression cylinder 8 up to the second foil-guiding element 19, which detaches the foil from the sheet 4 to guide it to the collecting reel over the foil-guiding elements 15. The area of engagement 50 is assigned a UV drier 17, which acts on the glue through the cold foil 11 to activate and dry the glue that has been applied to the sheet. In the illustrated embodiment, the glue that is being used is a UV glue that can be dried by the UV drier 17. As an alternative, the glue may be a type of glue that is activated or dried, for instance polymerized, in the infrared range or other ranges of the electromagnetic spectrum. If other types of glue are used, different types of driers may be provided.

Figure 2:
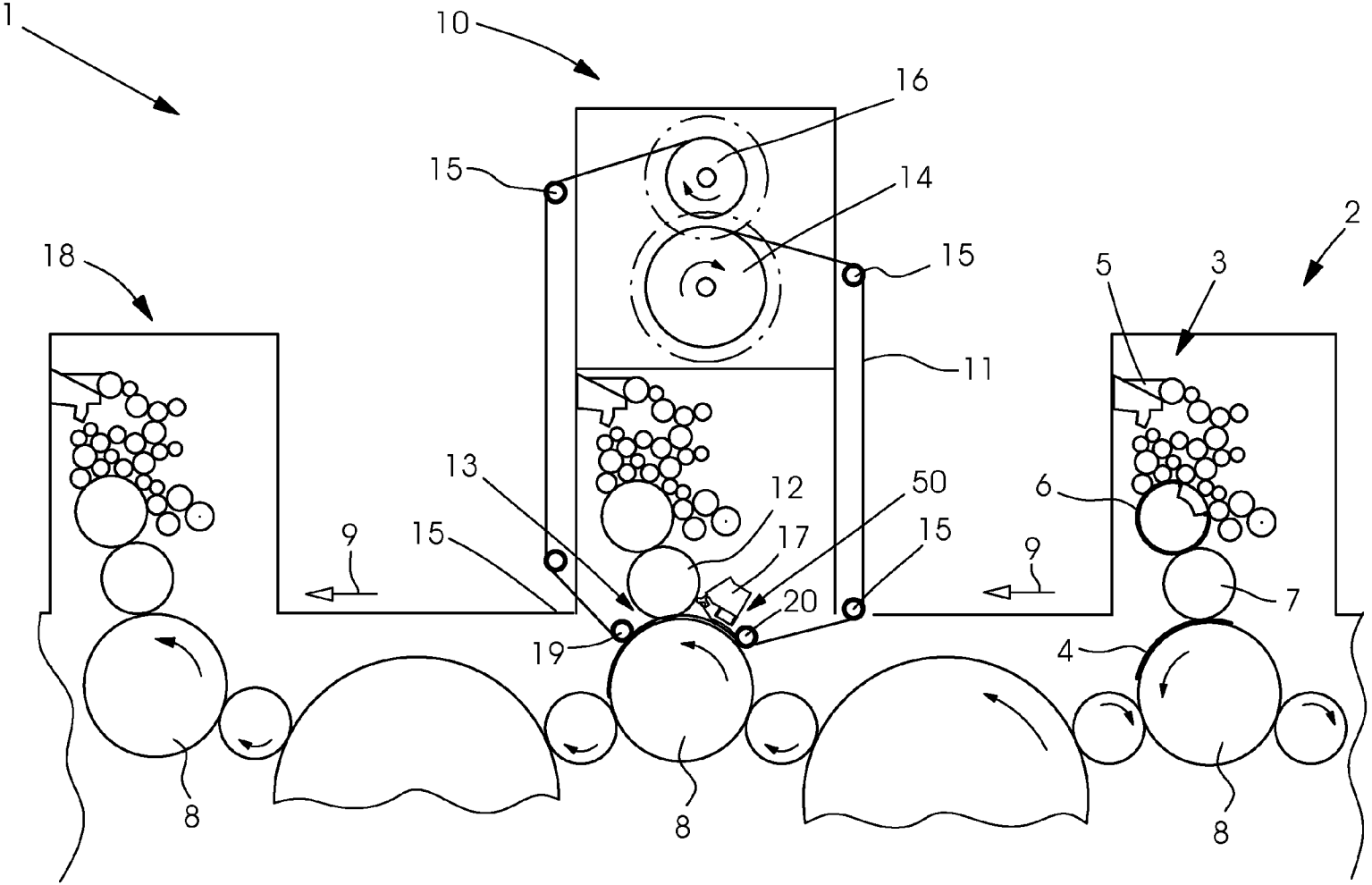
FIG. 2 is a fragmentary, longitudinal-sectional view of an alternative reconfiguration of a cold-foil device.

FIG. 2 illustrates an alternative configuration of the printing press 1 shown in FIG. 1. The difference is an alternative way of guiding the cold foil 11 at the impression cylinder 8. Identical elements are designated by the same reference symbols as in FIG. 1.

As described above with reference to FIG. 1, in FIG. 2, the sheet 4 and the cold foil 11 are also jointly guided through the transfer nip 13 to transfer the transfer layer to the sheet 4. An area of engagement 50 in which the cold foil 11 and the sheet 4 are jointly guided on the surface of the impression cylinder 8, is likewise provided. In contrast to the embodiment shown in FIG. 1, the transfer cylinder 12 is not simultaneously used as a guide element for guiding the foil 11 onto the impression cylinder 8. Instead, a third foil-guiding element 20 is provided upstream of the transfer cylinder 12 to receive the cold foil 11 guided by a foil-guiding element 15 in the direction of the transfer nip 13 and to guide it directly to the sheet 4 and onto the impression cylinder 8. The second foil-guiding element 19 is disposed downstream of the transfer nip 13. Thus, the area of engagement 50 starts upstream of the transfer nip and ends downstream of the transfer nip 13 at the second foil-guiding element 19, which guides the cold foil 11 to further foil-guiding elements 15, which in turn guide the cold foil 11 to the collecting reel 16. In this embodiment, the area of engagement 15 needs to be configured in such a way as to provide sufficient installation space upstream or downstream of the transfer nip 13 for providing a UV drier 17 for activating or polymerizing a UV glue on the sheet 4 through the cold foil 11. In the embodiment shown in the figure, the installation space for the UV drier 17 is provided upstream of the transfer nip 13. An analogous embodiment that includes a UV drier disposed downstream of the transfer nip 13 is likewise conceivable and easy to implement for a person skilled in the art. The same is true for two UV driers 17 provided upstream and downstream of the transfer nip 13.

Figure 3:
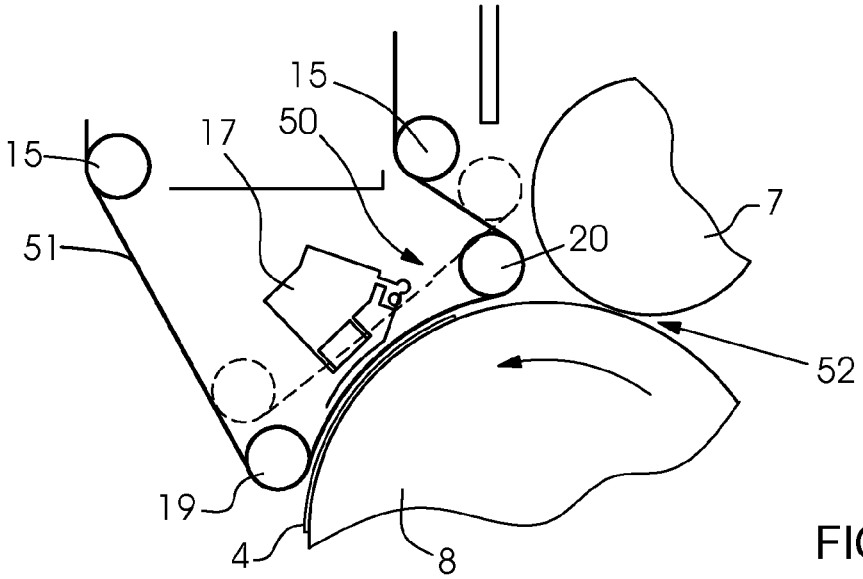
FIG. 3 is an enlarged, sectional view of a UV casting device.

FIG. 3 illustrates an embodiment in which a hologram foil 51 is guided together with a sheet 4 along the impression cylinder 8 in an area of engagement 50. In this case, the hologram foil 51 is likewise guided to the area of engagement 50 by foil-guiding elements 15. In a manner analogous to the transfer unit 10, supply reels and collecting reels may be provided for the hologram foil 51. For reasons of clarity, the supply reels and collecting reels for the hologram foil 51 are not illustrated.

In contrast to the guide system for guiding the cold foil 11 in FIGS. 1 and 2, the hologram foil 51 is guided on the impression cylinder 8 together with the sheet 4 without the influence of a transfer cylinder 12 and without the presence of a transfer nip 13. Thus, the hologram foil 51 may be provided, in particular, in a unit without a transfer or blanket cylinder 12 or 7. The only feature which is necessary to apply the hologram foil 51 to the sheet 4 in a coating process is the presence of an area of engagement 50 between a second foil-guiding element 19 and a third foil-guiding element 20. The second foil-guiding element 20 may expressly be a blanket cylinder 7 of a printing unit. The hologram foil 51 is a foil with a structured surface, in particular a diffractive surface. When the hologram foil 51 is placed on the printing material 4 to which a layer of varnish has been applied, the roughness of the surface of the hologram foil 51 causes a pattern to be created exclusively in the layer of varnish in the form of a micro-embossing or a nano-embossing. In order to create this pattern in a layer of varnish, a layer of varnish instead of glue needs to be applied to the sheet 4 in an upstream application unit 2. Advantageously, a printing unit as shown in FIGS. 1 and 2 is used for this purpose, i.e. for applying varnish to the sheets instead of glue. In an alternative embodiment, a varnishing unit may be used to apply the layer of varnish. However, a printing unit has proved to be particularly advantageous for the application of the layer of varnish. The layer of varnish may, in particular, be applied depending on the image, i.e. only in defined areas on the sheet 4. The varnish that is applied in the given example is preferably a UV varnish that has not yet polymerized on the sheet 4 when it is fed to the area of engagement 50. However, it is possible for the layer of varnish to be partly polymerized in an upstream UV drier to provide the possibility of embossing a pattern into the layer of varnish using the hologram foil 51 while at the same time preventing or at least reducing any offsetting of the layer of varnish onto the hologram foil 51 as the hologram foil 51 is detached at the second foil-guiding element 19. As the layer of varnish and the sheet 4 are guided into the area of engagement 50 at the third foil-guiding element 20, the structure of the hologram foil 51 is formed in the varnish. In the area of engagement, a UV drier 17 is provided to harden the layer of varnish. This UV drier 17 polymerizes the entire layer of varnish through the hologram foil 51 to stabilize the shape that has been transferred from the hologram foil to the layer of varnish.

In the hologram unit that is constructed as shown in FIG. 3, a conventional printing unit including an impression cylinder 8 and a blanket cylinder 7 is used to accommodate the unit including the second and third foil-guiding elements 19, 20, foil-guiding elements 15, and the UV drier 17 downstream of a printing nip 52 at the impression cylinder 8. Thus, a conventional printing unit can easily be modified to create a hologram unit. The layer of varnish can be applied to the sheet 4 in an upstream varnishing or printing unit 2, irrespective of whether the hologram unit does or does not include a blanket cylinder 7 at the impression cylinder 8 of the hologram unit. In accordance with a particularly advantageous embodiment, it is conceivable to place the hologram unit downstream of the printing nip 52 as in the illustrated example, thus providing the possibility of using the blanket cylinder 7 to apply a layer of varnish to the sheet 4 directly on the same impression cylinder 8 on which the area of engagement 50 is provided. A device with a particularly compact size is provided in accordance with this embodiment.

If the sheet 4 is held on the impression cylinder 8 by non-illustrated grippers, parts of the grippers may protrude beyond the surface of the impression cylinder 8 and may thus come into contact with the hologram foil 51 and potentially damage the surface of the latter. Since the hologram foil 51 may potentially be reused, in an alternative embodiment, the second and third foil-guiding elements 19, 20 may be disposed or mounted in such a way as to be able to be disengaged from the impression cylinder 8 to allow the grippers to pass instead of being disposed in a fixed radial position relative to the impression cylinder 8. The path of the hologram foil 51 and the position of the second and third foil-guiding elements 19, 20 is illustrated in dashed lines for this embodiment. In general, the foil-guiding elements 19 and 20 may also be engaged and disengaged in a corresponding way to place the hologram or cold-foil unit out of operation. If this is the case, the foil-guiding elements 19, 20 are moved into a stand-by position.

Figure 4:
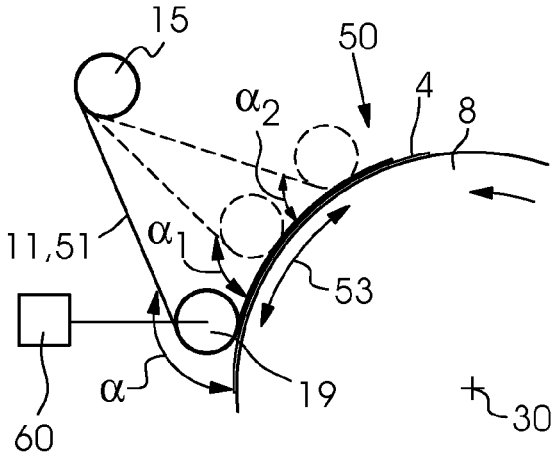
FIG. 4 is a sectional view of a pivotable foil-guiding element.

FIG. 4 discloses a foil-guiding element 19 that is pivotable about an external geometrical pivot axis 30 in accordance with the invention. An upstream foil-guiding element may be provided as a third foil-guiding element 20 and may alternatively or additionally be pivotable about an external geometrical pivot axis 30 in an analogous manner. As an alternative, a blanket cylinder 7 may be provided as an associated foil-guiding element to define the area of engagement 50 together with the second foil-guiding element 19. For reasons of clarity, FIGS. 4 and 5 exclusively illustrate the second foil-guiding element 19 with an external and an internal geometrical pivot axis 31, 30. The same pivotability may additionally or alternatively be provided for a third foil-guiding element 20 that is provided upstream of the second foil-guiding element 19. A switching member 60 that is connected to the foil-guiding elements 19, 20 to pivot the latter is provided to switch a foil-guiding element 19, 20 from one condition to another.

Figure 5:
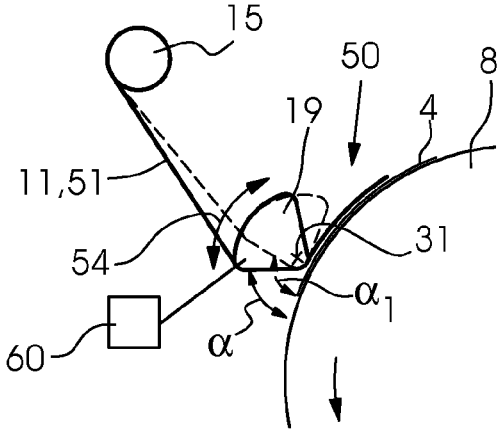
FIG. 5 is a sectional view of an alternative pivotable foil-guiding element.

The embodiments shown in FIGS. 4 and 5 may guide a hologram foil 51 or a cold foil 11. As described above, a foil 11 or 51 is guided around the second foil-guiding element 19 to the foil-guiding elements 15. In the process, the foil 11, 51 forms an angle of detachment a with the sheet 4 or with the surface of the impression cylinder 8. As is shown in FIG. 4, the second foil-guiding element 19 is pivotable about an external geometrical pivot axis 30 in a direction indicated by a double-headed arrow 53 in such a way that the radial position of the second foil-guiding element 19 relative to the impression cylinder 8 does not change, whereas the circumferential position changes to cause the foil 11, 51 to follow different paths as the position of the second foil-guiding element 19 varies. The varying positions of the second foil-guiding element 19 relative to the circumference of the impression cylinder 8 are represented in dashed lines. The same applies to the path of the web of foil 11, 51. Thus, depending on the different circumferential positions, which are obtained by a pivoting movement about the external geometrical pivot axis 30 along the double-headed arrow 53, different angles of detachment $\alpha_1$, $\alpha_2$ can be obtained for the detachment of the foil 11, 51 from the sheet 4.

FIG. 5 illustrates an alternative in which the second foil-guiding element 19 pivots about an internal geometrical pivot axis 31. The second foil-guiding element 19 has a special type of surface profile, outline or shape which, in the illustrated example, is a substantially triangular profile. Other profiles are likewise conceivable. Due to the special type of surface profile of the second foil-guiding element 19, different pivoting conditions of the second foil-guiding element 19 cause different surface areas of the second foil-guiding element 19 to become effective in terms of an interaction between the second foil-guiding element 19 and the foil 11, 51 as the second foil-guiding element pivots about the internal geometrical pivot axis 31 in the direction of a double-headed arrow 54. These different positions of the second foil-guiding element 19 are represented in dashed lines. The same applies to the different paths of the foil 11, 51 created by the different positions. It is evident from the drawings that the angle of detachment a can easily be changed to an angle of detachment $\alpha_1$ without changing the circumferential or radial position of the second foil-guiding element 19 relative to the impression cylinder 8.

In addition to the options shown herein of pivoting the second foil-guiding element 19 about an internal or an external geometrical pivot axis, the second foil-guiding element 19 may be disposed or mounted in such a way as to able to be disengaged as described with reference to FIG. 3. The same applies to the third foil-guiding element 20.

Figure 6A:
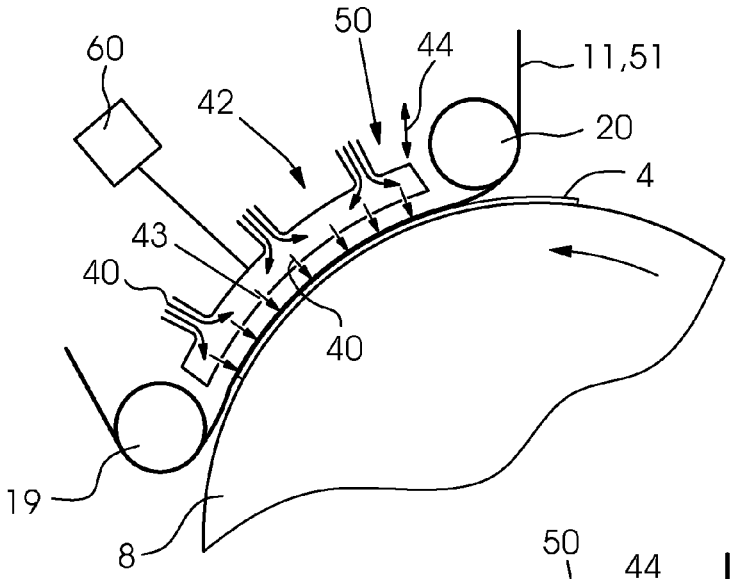
FIGS. 6A and 6B are further enlarged, sectional views illustrating different conditions of a pneumatically actuatable foil-guiding element.
Figure 6B:
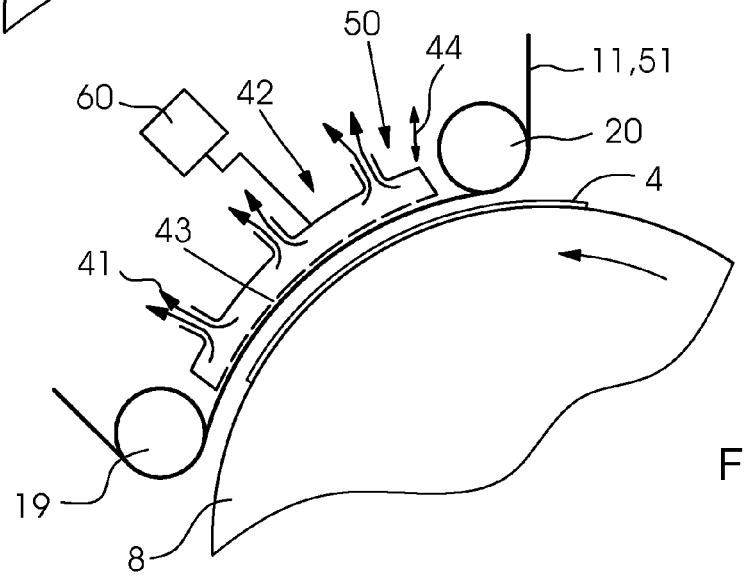

FIGS. 6A and 6B illustrate an alternative embodiment of different foil-guiding elements 19, 20 and a fourth foil-guiding element 42. All of the foil-guiding elements 19, 20, 42 are disposed to be stationary in the circumferential direction and in the radial direction relative to the impression cylinder. The second and third foil-guiding elements 19, 20 do not touch the impression cylinder 8. The fourth foil-guiding element 42 is pneumatically activatable in order to engage a cold-foil 11 or a hologram foil 51 with the cylinder. In a condition illustrated in FIG. 6A, compressed air 40 is supplied to the fourth foil-guiding element 42 and is guided to the back side of the foil 11, 51 through air openings 43.

A change of condition of the foil 11, 51, in particular to disengage the foil 11, 51 from the surface of the impression cylinder 8, is illustrated in FIG. 6B. Due to a pneumatic activation of the fourth foil-guiding element 42, suction air 41 instead of compressed air 40 is supplied to the fourth foil-guiding element 42. Thus, the foil 11, 51 is drawn towards the fourth foil-guiding element 42 by suction and does not touch the surface of the impression cylinder. Instead, the foil 11, 51 is pulled away from the surface of the impression cylinder. Since the second and third foil-guiding elements 19, 20 are permanently disengaged from the cylinder, the foil 11, 51 is no longer in contact with the impression cylinder 8. Damage to the foil 11, 51 caused by grippers is avoided. This applies, in particular, if there is a difference of speeds between the grippers and the foil 11, 51, which may be the case, for instance, during a fixed cycle operation or a washing cycle of the printing press.

Figure 7:
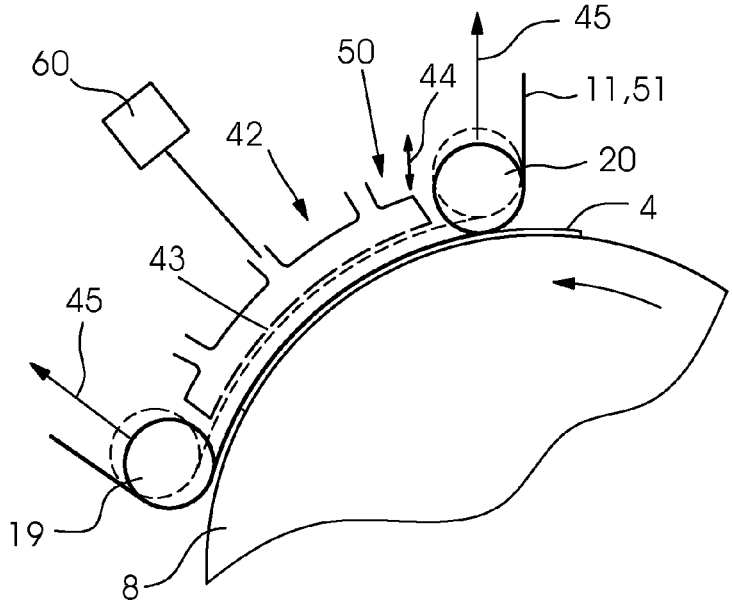
FIG. 7 is a sectional view of an alternative configuration of foil-guiding elements.

An alternative embodiment of this configuration is shown in FIG. 7. In contrast to the second and third foil-guiding elements 19, 20 of FIGS. 6A, 6B, the second and third foil-guiding elements of FIG. 7 are disposed or mounted in such a way as to be disengaged from the impression cylinder 8 in the direction of an arrow 45. Thus, in order to transfer a transfer layer or to emboss a pattern using a hologram foil 51, the foil 11, 51 may be engaged with the sheet 4 in the engagement area 50 exclusively through the use of the second and third foil-guiding elements 19, 20. Alternatively, the engagement may be assisted in using compressed air 40 as described in the context of FIG. 6A. In order to disengage the foil 11, 51 from the sheet 4 or from the impression cylinder 8, the second and third foil-guiding elements 19, 20 are disengaged in the direction of the arrow 45. As described in the context of FIG. 6B, the disengagement of the foil 51, i.e. the change of condition of the foil 11, 51, may be assisted by suction air 42. Thus, like in the embodiments shown in FIGS. 6A and 6B, in FIG. 7 too, the foil 11, 51 may be engaged with the sheet 4 and disengaged from the surface of the impression cylinder 8 in the direction of a double-headed arrow 44 assisted by the fourth foil-guiding element. Through the use of the second, third and fourth foil-guiding elements 19, 20, 42 described with regard to FIGS. 4 to 7, the detachment behavior of the foil 11, 51 from the sheet 4 or the impression cylinder 8 may at least be improved or varied in a corresponding manner to avoid losses of quality in the coated sheet 4 resulting from variations in the detachment behavior and optimizing the quality of the coated sheet 4.

The invention claimed is:

1. A method for coating a printing material using a web of foil, the method comprising the following steps:

applying a coating of glue, varnish or another functional layer to the printing material;

feeding a web of foil from a foil supply to an area of engagement using foil-guiding elements;

engaging the web of foil temporarily with the printing material in the area of engagement while guiding the printing material on a counter-surface, the counter-surface being a surface of an impression cylinder;

changing a path of the web of foil relative to the counter-surface at least from a first condition to a second condition using the foil-guiding elements to guide the web of foil; and implementing the change of condition by changing at least one condition of at least one of the foil-guiding elements to switch the web of foil from a first to a second condition, the change of condition of the at least one foil-guiding element being different from a disengagement of the at least one foil-guiding element from the counter-surface and being carried out without changing the radial position of the at least one foil-guiding element relative to the impression cylinder.

2. The method according to claim 1, which further comprises carrying out the change of condition of the at least one foil-guiding element as one of a group of changes of condition consisting of pivoting about an internal geometrical pivot axis, pivoting about an external geometrical pivot axis, and changing a pneumatic condition.

3. The method according to claim 2, which further comprises using the change of the pneumatic condition to at least assist in changing the web of foil from a first condition to a second condition with at least one of suction air or compressed air.

4. The method according to claim 1, which further comprises forming a different angle of detachment of the web of foil with the counter-surface in the second condition than in the first condition.

5. The method according to claim 1, which further comprises at least partially detaching the web of foil from the counter-surface in the second condition.

6. The method according to claim 1, which further comprises:

placing the web of foil in guiding interaction with a first surface area of the at least one foil-guiding element;

placing the web of foil in guiding interaction with a second surface area of the at least one foil-guiding element after pivoting the at least one foil-guiding element; and varying an angle of detachment of the foil from the counter-surface due to the change of condition of the at least one foil-guiding element.

7. A device for coating a printing material, the device comprising:

at least one coating unit for coating the printing material with a functional layer;

an area of engagement, disposed downstream of said at least one coating unit in a transport direction of the printing material, for temporarily engaging a web of foil with the printing material;

a counter-surface for guiding the printing material during engagement with the web of foil, said counter-surface being a surface of an impression cylinder;

a guide device including foil-guiding elements for guiding the web of foil in vicinity of said counter-surface; and a switching element associated with at least one of said foil-guiding elements and configured to be switched for causing a change of condition of said at least one foil-guiding element, said change of condition being different than a disengagement of said at least one foil-guiding element from said counter-surface and being carried out without changing the radial position of said at least one foil-guiding element relative to said impression cylinder, and said switching of said switching element causing the web of foil to change from a first condition to a second condition.

8. The device according to claim 7, wherein said at least one foil-guiding element is one foil-guiding element selected from a group of foil-guiding elements consisting of guide elements being pivotable about an internal geometrical pivot axis, guide elements being pivotable about an external geometrical pivot axis and guide elements being pneumatically activatable.

9. The device according to claim 8, wherein said guide element being pivotable about an internal geometrical pivot axis includes a surface profile providing a different contour for an effective surface for guidingly interacting with the foil as a function of a pivoting condition of said guide element.

10. The device according to claim 8, wherein said guide element being pivotable about an external geometrical pivot axis is configured to experience a change of condition by pivoting from a first circumferential position relative to said counter-surface into a second circumferential position relative to said counter-surface, with a radial distance of said guide element from said counter-surface remaining substantially constant, and with at least one of an angle at which the foil wraps around said counter-surface or an angle of detachment of the foil relative to said guide element, being changed from a first condition to a second condition.

11. The device according to claim 8, wherein said pneumatically activatable guide element includes at least one of suction-air openings for receiving air or compressed-air openings for expelling air, said openings being directed toward a side of the web of foil facing away from the printing material for at least assisting a disengagement of the web of foil from said counter-surface.

* * * * *